United States Patent [19]

Rut

[11] Patent Number: 4,646,551

[45] Date of Patent: Mar. 3, 1987

[54] APPARATUS FOR FORGING OF CRANKSHAFTS IN PRESSES

[75] Inventor: Tadeusz Rut, Poznan, Poland

[73] Assignee: Instytut Obrobki Plastycznej, Poznan, Poland

[21] Appl. No.: 677,812

[22] Filed: Dec. 4, 1984

[30] Foreign Application Priority Data

Dec. 13, 1983 [PL] Poland ..... 245115

[51] Int. Cl.[4] ..... B21K 1/08

[52] U.S. Cl. ..... 72/305; 72/304; 72/357; 29/6

[58] Field of Search ..... 72/305, 300, 296, 297, 72/353, 357, 402, 403, 308, 309, 304; 29/6

[56] References Cited

U.S. PATENT DOCUMENTS

| | | | |
|---|---|---|---|
| 2,535,295 | 12/1950 | Lafont | 29/6 |
| 2,827,685 | 3/1958 | Cleghorn | 29/6 |
| 3,129,488 | 4/1964 | Robra et al. | 29/6 |
| 3,348,407 | 10/1967 | Rut | 72/450 |
| 3,650,143 | 3/1972 | Ruget | 29/6 |
| 3,688,552 | 9/1972 | Ruget | 72/402 |
| 3,867,832 | 2/1975 | Rut | 72/399 |
| 4,041,755 | 8/1977 | Rut | 72/353 |
| 4,272,979 | 6/1981 | Rut | 72/403 |

FOREIGN PATENT DOCUMENTS

| | | | |
|---|---|---|---|
| 757526 | 9/1956 | United Kingdom | 29/6 |

*Primary Examiner*—Daniel C. Crane
*Attorney, Agent, or Firm*—Ladas & Parry

[57] ABSTRACT

An apparatus for forging crankshafts comprises a base which consists of beams 4 and cross-members 12 and 25. The head 3 of the device is designed for reciprocal movement in relation to the base. Between head 3 and parts 4 and 25 of the base there is a pair of movable, mutually coupled die holders 5 and 8, from which the top die holder 5 is led perpendicularly or at an oblique angle in relation to the head movement and the bottom die holder 8 is connected with the base by means of articulated connectors 6 and 7. Clamping die inserts 10 and 11 for gripping the forged material are fastened in die holders 5 and 8. The device is also equipped with a second pair of die holders 13, 12, 12*a,* 4*d,* which remain stationary and are fixed to the base during the working stroke of the press by means of a clamping mechanism 14 and 15. Die inserts 22 and 23 for forming crank webs and angle die inserts 17, 18 and 20 for setting crank webs at proper twist angles are mounted into the said stationary pair of die holders.

7 Claims, 23 Drawing Figures

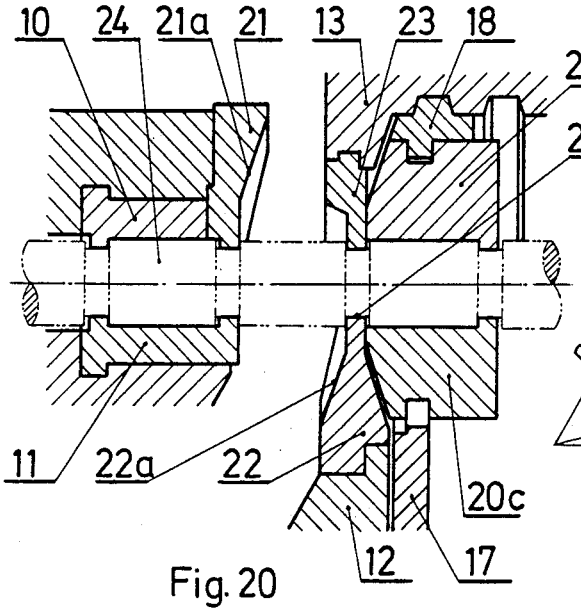
Fig. 20
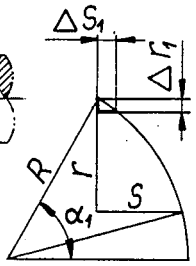
Fig. 21
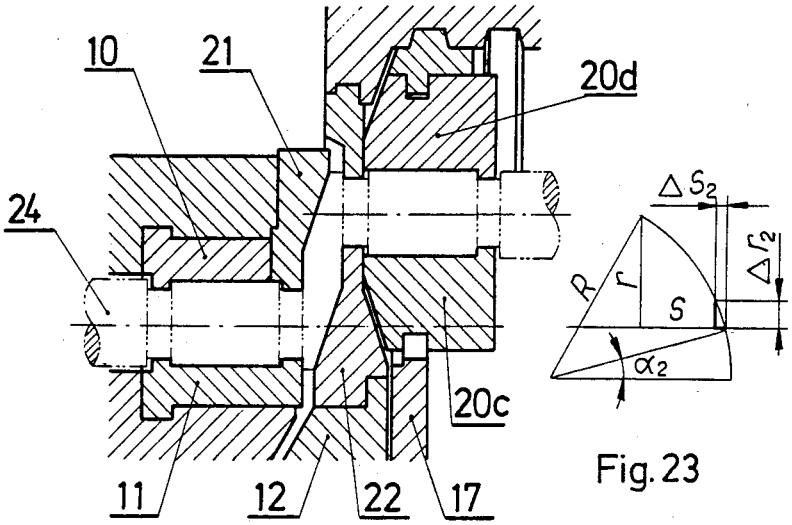
Fig. 23
Fig. 22

APPARATUS FOR FORGING OF CRANKSHAFTS IN PRESSES

BACKGROUND OF THE INVENTION

The invention relates to a method of and a forging device for forging crankshafts especially in presses.

In a known method of forging crankshafts in presses a bar is clamped by clamps located at a certain distance and a bar portion between these clamps is upset and simultaneously bent and joggled radially to the bar axis. At the beginning of the working stroke the upsetting velocity is higher than the bending velocity whereas at the end of the working stroke the upsetting velocity is lower then the joggling one.

This known method is used for forging a crank throw so that two crank webs and a crank pin between them are forged during one working stroke. The devices for forging crankshafts by the above said method are known for example from Polish patent specification Nos. 468874, 50720 and 50253 and the U.S. Pat. No. 3,348,407.

Similar devices for forging crankshafts by the method of simultanous upsetting and bending a bar are also known from the Polish patent specification Nos. 112203 and 122409 and the U.S. Pat. No. 4,272,979. These devices are designed to be mounted on a free forging hydraulic press. Each of these devices consists of a base and a head which is designed for reciprocal movement in derection to the base. Between the base and the head the devices are provided with two pairs of movable and mutually coupled die holders which are guided perpendicularly or at an oblique angle to the direction of the head movement. Each of the movable pairs of the die holders is connected with the base by two articulated connectors.

In the said die holders die inserts are fixed for shaping crank webs, crank pins and bearing journals. Between face surfaces of these die inserts there is a bending tool rigidly fixed to the base and an anvil rigidly fixed to the head. During the working stroke, the vertical movement of the head is transformed by the articulated connectors into a horizontal movement of the split die inserts and the holders toward each other, while a bar portion situated between them undergoes upsetting. The horizontal upsetting force which appears in this device can be aproximatively calculated from the formula $$P_{h1}=0.5N_p(\cot\alpha-\mu)$$

where $N_p$—press capacity, $\alpha$—inclination angle of articulated connectors, $\mu$—coefficient of friction between sliding elements of the device.

The upset material is bent simultaneously toward the anvil by the bending tool. During the working stroke of the device the bending velocity increases in relation to the upsetting velocity to such extent that at the final phase of operation the bending turns into joggling of crank pin material in relation to the material of two adjacent main bearing journals. In this final operation phase the crank throw webs are formed.

This known method and devices could not be applied for forging of long stroke crank throws, particularly for high-power marine engines, because the relation of the bar length which is to be upset between the upsetting dies to the bar diameter would be too high.

The length of the bar which is upset depends on the crank throw volume i.e. volumes of two crank webs and a crank pin. Exceeding the upsetting ratio during the upsetting process causes incorrect forming of the crank webs and also irregular grain flow of the crank throw.

It can be assumed that the biggest free forging presses have capacities from 80 to 120 MN. By means of these presses and the known forging methods and devices solid crankshafts with crank throw stroke up to about 1200 mm can be forged. This limitation results both from the capacity of the press and working space (distance between the press crosshead and the press table, distance between columns, stroke of the press crosshead). However, the biggest crankshafts applied in marine Diesel engines have the stroke up to 2925 mm, so there is not any possibility to forge crankshafts with the stroke larger than 1200 mm. These types of long stroke crankshafts are produced up to now as semi-built up crankshafts assembled by shrinking.

Solid crankshafts have many advantages in comparision with semi-built up crankshafts. Smaller overall dimensions of solid crankshafts allows diminishing the dimensions and weight of engines. Designers and marine Diesel engine producers have undertaken experiments to introduce crankshafts assembled by welding instead of semi-built up crankshafts. However, the welding process is very expensive and time consuming and also demands testing of the welds.

SUMMARY OF THE INVENTION

An object of invention is to provide a method and a device for forging solid crankshafts especially with long crank throw stroke which allow to apply smaller forming force and to avoid exceeding the upsetting ratio during the first phase of forging process.

According to the invention during one working stroke of the press crosshead only one crank web is forged in such a manner that the hot portion of a bar is fastened by two clamps, one or which is arranged on the said bar portion in the place which is designed to be the crankshaft's main bearing journal and the second of these clamps is arranged in the place designed to be the adjacent crank pin. Between these places the crank web is formed by means of known simultaneous upsetting, bending and joggling operations. Next crank webs are forged and directed at proper twist angle during successive working strokes of the press crosshead.

Using the method according to the invention there is no fear of exceeding the permissible upsetting ratio because a bar portion for forming only one crank web is shorter than the one for forming the whole crank throw.

Similar to other known designs the device for forging crankshafts comprises a base and a head mounted above the base for reciprocal movement in the direction to the base. In the zone between the head and the base movable die holders are provided, which are coupled together, are lead perpendicularly or at an oblique angle in relation to the head movement and are linked to the base by means of articulated connectors, assuring the parallel motion of the die holders in relation to the base. In these die holders die inserts are mounted for forming crank webs and bearing journals or crank pins.

According to the invention the device comprises only one pair of the afore said mutually coupled movable die holders and it comprises a second pair of die holders, which are immovable during the working stroke, are ridigly connected with the base and are provided with clammping means for connecting the immovable die holders together. The said immovable die holders are provided with inserts for forming crank webs, crank pins and bearing journals and also die inserts for setting the adjacent crank webs at proper twist angles.

The upsetting force which appears in the forging device according to the invention can be calculated from the formula $$P_{h2}=N_p(\cot\alpha-\mu)$$

where $N_p$, $\alpha$ and $\mu$ have the above said meaning. That force is twice bigger than the upsetting force which appears, when forging in the devices according to previous solutions. So it is possible to forge the same crankshafts types in presses of smaller capacities. Another feature of the device according to the invention is that the device can be mounted on presses of relatively smaller working space. This feature will be discussed further on.

It is advantageous when the second pair of die holders which is fixed ridigly to the device base is positioned beyond the space between the device head and—in plumb line—the base.

The base of the device should consists of two base beams of the shape similar to the letter "U". The top parts of each base beam is tied by means of a steady brace. Both beams are interconnected by means of two cross members. One of the two base cross members is connected to the bottom of articulated connectors for linking the movable die holders parallel to the device base, and the other cross member is the bottom part of the second pair of die holders, which are immovable during the working stroke of the press.

It is also advantageous when the clamping means which are applied in the device according to the invention consist of at least one arrester hook which is pivotably mounted on the base and in its closed position rests on a half-round bearing shaft which is placed in the top part of the second pair of die holders.

It is favourable when the die inserts for setting the formed crank web at proper twist angle are split and consist of a top and a bottom part, said die inserts are provided with an impression and recesses which are situated correspondingly to twist angles of the adjacent crank webs. In said impression a rotary angle die insert is mounted provided with a recess for directing the bearing journal or crank pin in a desired position.

Operating the device is more convenient when the top part of the second pair of die holders is equiped with a catch for raising the top part of the die holder together with the device head.

To improve the device operation the head of the device can be provided with vertical guides which rest during the working stroke of the device on vertical guides mounted in the device base.

The device according to the invention can cooperate with presses. In this case the head of the device is fastened to the press-crosshead and the base to the press table. The device can also be equiped with its own individual drive means.

BRIEF DESCRIPTION OF THE DRAWINGS

Examples of devices according to the invention are shown on the annexed drawings. In these drawings FIG. 1—shows the open device in side view without die inserts.

FIG. 20—shows lengthwise section of the die inserts when clamping the bar stock for forging the first crank web.

FIG. 21—shows the diagram of upsetting and bending velocities at the beginning of working stroke.

FIG. 22—shows lengthwise section of the die inserts for forging the first crank web at the end of operation.

FIG. 23—shows the diagram of upsetting and bending velocities at the end of working stroke.

DESCRIPTION OF THE PREFERRED EMBODIMENTS

Figure 1:
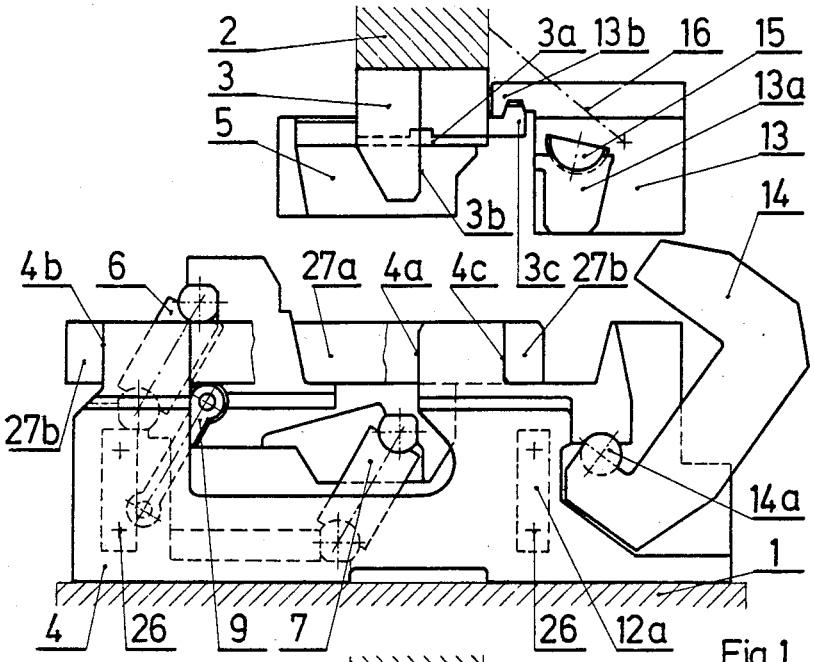
Figure 2:
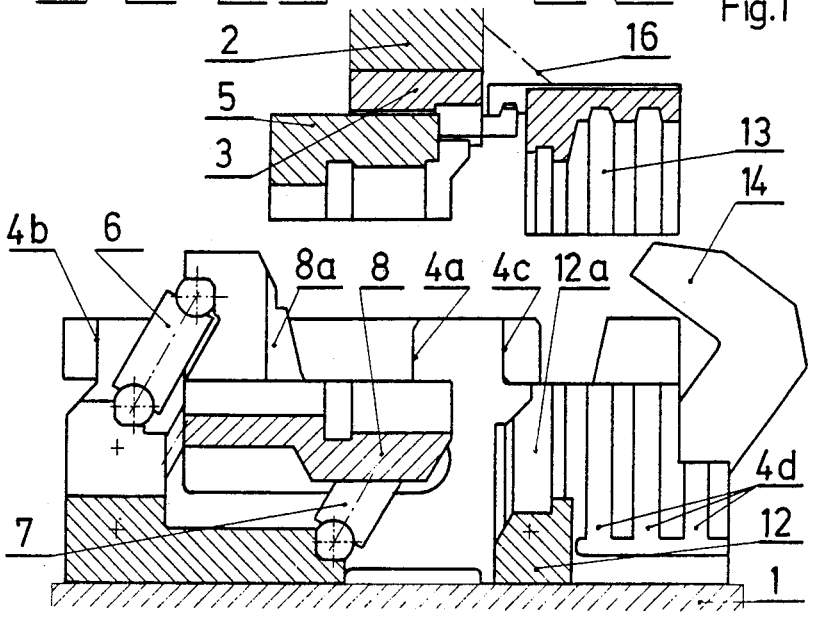
FIG. 2—shows lengthwise section of the device acc. to FIG. 1.
Figure 3:
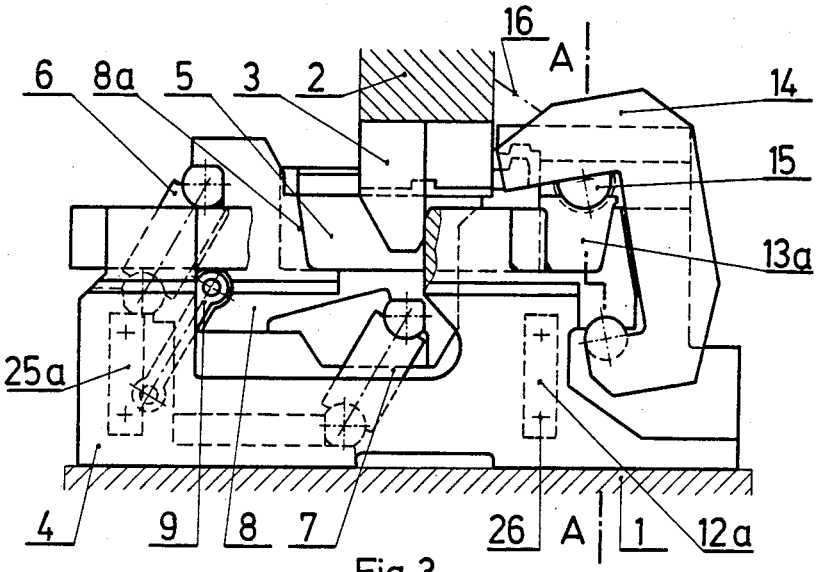
FIG. 3—shows the same device with die inserts when clamping the material for forming the second crank web of the next throw.
Figure 4:
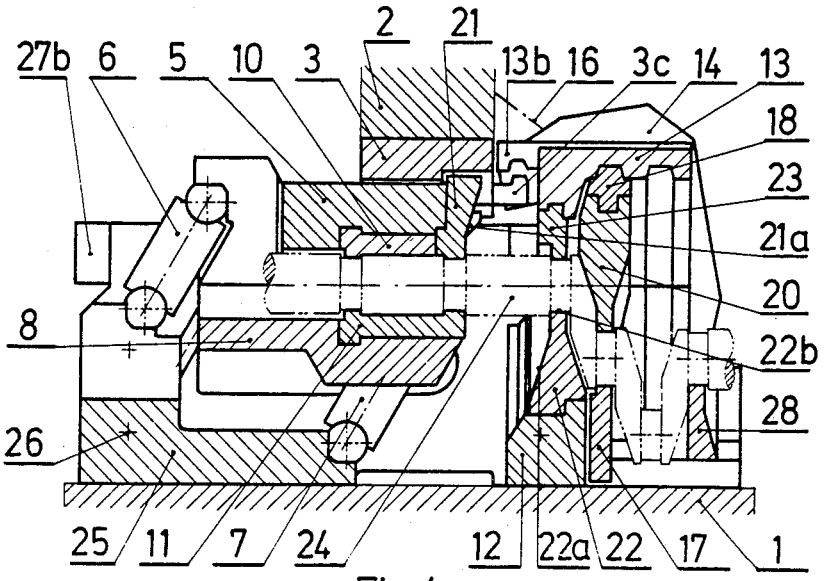
FIG. 4—shows lengthwise section of the device acc. to FIG. 3.
Figure 5:
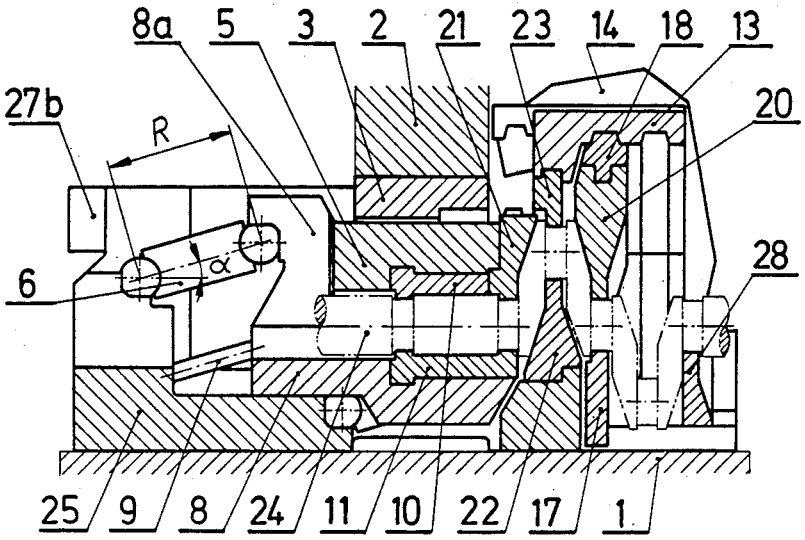
FIG. 5—shows the device with die inserts at the end of second crank web forming operation.

A device according to the invention is installed in a press which has a table 1 and a vertically moving crosshead 2. The device head 3 is fastened to the press crosshead 2 and on the table 1 are mounted base beams 4. The construction of the device base will be discussed further on. The device head 3 has horizontal guides 3*a* on which a first movable top die holder 5 is shifted. On the head 3 there are also vertical guides 3*b* which cooperate with the corresponding guides 4*a* in the base beams 4. The bottom ends of four articulated connectors are pivotably linked to the base. The outer articulated connectors are marked on the drawing by number 6 and the inner one by number 7. The top ends of these connectors are pivotably linked to a first movable bottom die holder 8 and create a parallel mechanism which assures the parallel movement of the die holder 8 in relation to the device base. In the bottom die holder 8 there is a protrusion 8*a* for coupling the bottom die holder with the top die holder 5. Die holders 5 and 8 create a pair of interconnected die holders which move during the working stroke. The bottom die holder 8 is additionally linked to the base by means of links 9. The upper part of a split die insert 10 for clamping the bar during forging process is mounted in the top die holder 5. The bottom part 11 of this die insert is mounted in the bottom die holder 8.

Besides the above said die holders 5 and 8 and die inserts 10 and 11 the device comprises a second bottom die holder which is constructed as follows: its bottom part 12 is placed between the base beams 4 and creates a cross member interconnecting these beams. In this part 12 there is an impression 12*a* for setting tools. Also in the base beams 4 there are impressions 4*d* for fastening tools. These tools are discussed further on. Above the bottom die holder there is a second top die holder 13 which composes with the bottom one a second pair of die holders. This second pair of die holders is immovable during the working stroke of the device. The top die holder 13 is not fixed to the device head 3, but in order to facilitate positioning the bar which is to be forged and taking out the forging from the device, the die holder 13 can be underslung to the head 3 when raising the press crosshead 2. During the working stroke of the device the top die holder 13 is quite independent of the head 3.

Two arrester hooks 14 are pivotably fastened to the base through pins 14*a*. The second top die holder 13 is provided with lateral protrusions 13*a* on which there are half-round bearing shafts 15. When the device is closed this bearing shafts 15 are caught by the arrester hooks. The second top die holder 13 is provided with a catch 13*b* which engages the similar catch 3*c* in the device head 3 when opening the device. Said die holder 13 is also provided with a coupling bar 16 which serves for underslinging the die holder 13 to the press crosshead 2. The catch 13*b* and the coupling bar 16 facilitate the manipulation with top die holder 13 when opening the device.

Figure 12:
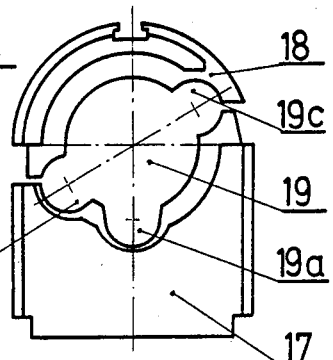
FIG. 12—shows front view of the angle die insert acc. to FIG. 11 designed for forging six-throw crankshafts.
Figure 13:
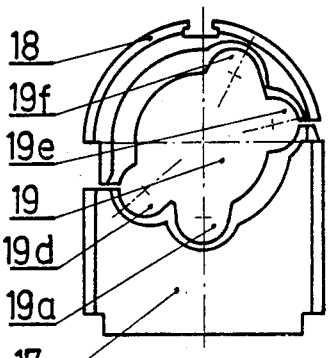
FIG. 13—shows the angle die insert like in FIG. 11 for forging seven-throw crankshafts.
Figure 14:
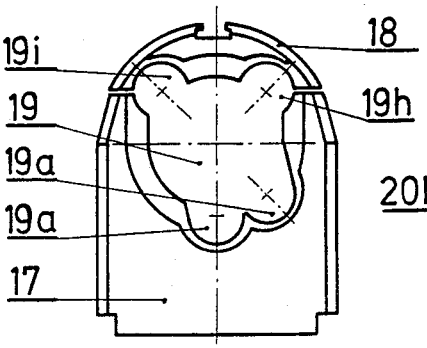
FIG. 14—shows the angle die insert like in FIGS. 12 and 13 but for forging eight-throw crankshafts.
Figure 15:
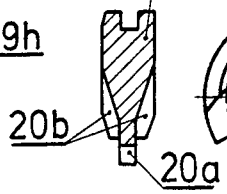
FIG. 15—shows lengthwise section of the rotary angle die insert for the dies from FIGS. 11-14.
Figure 16:
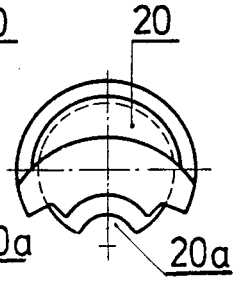
FIG. 16—shows front view of the same rotary angle die insert.
Figure 17:
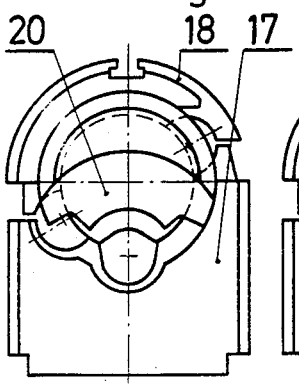
FIG. 17—shows the front view of the angle die insert with rotary angle die insert adjusted for forging the second crank web of the same crank throw (main bearing journal is fixed).
Figure 18:
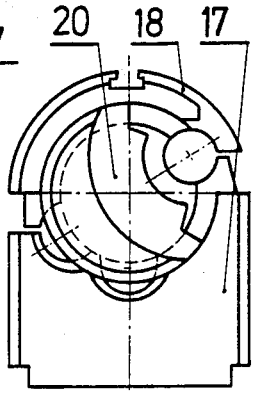
FIG. 18—shows angle die insert like in FIG. 17 but adjusted for forging the first crank web of the next crank throw (crank pin is fixed).
Figure 19:
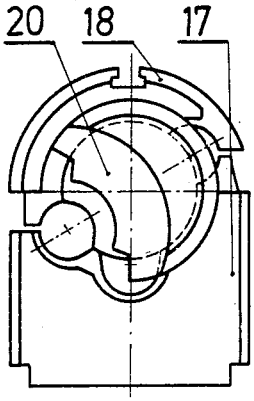
FIG. 19—shows angle die insert like in FIGS. 17 and 18 but the rotary angle die insert is adjusted for forging the first crank web of the next crank throw at a different twist angle as it is shown on FIG. 18 (crank pin is fixed).

Between the second bottom die holder 12, 12*a*, 4*d* and the second top die holder 13 an angle die insert is mounted for setting the neighbouring crank webs at proper twist angle. This angle die insert consists of three parts. The bottom part 17 of this angle die insert is set in the second bottom die holder 12, 12*a*, 4*d*. The top part 18 of the above said die insert is set in the second top die holder 13. Together in both parts (17, 18) there is an impression 19. In the impression 19 of the bottom die insert 17 there is a recess 19*a*. The center of the recess 19*a* is located in the vertical symmetry plane of the device. The recess is used when forging the second crank web of each crank throw. Detailed description of the recess application will be provided further on. Moreover, in the impression 19 of both parts 17 and 18 there are additional recesses 19*b*, 19*c*, 19*d* . . . 19*i* situated at proper angles according to just forged crankshaft construction. The shape of the impression and arrangement of recesses for forging of six-throw crankshafts is shown on FIG. 12. FIG. 13 shows the impression and recesses for forging of seven-throw crankshafts and FIG. 14 shows the same for forging of eight-throw crankshafts.

The third part of the above said angle die insert is a rotary die insert 20 for setting the crank webs of the same crank throw at proper twist angle. This rotary die insert 20 has on its circumference one recess 20*a*. The two surfaces 20*b* of the rotary die insert have a profile of concave frustoconical sectors. This die insert is placed coaxialy in the impression 19 and can be rotated.

The top part 21 of a split die insert for shaping crank webs is placed on the face surface of the first movable top die holder 5, and the bottom part 22 of this split die insert is fastened to the second immovable bottom die holder 12 and 4*d*. The face working surface 21*a* of the top die 21 and the face working surface 22*a* of the bottom die 22 have a profile of concave frustoconical sectors. In the second top die holder 13 a clamping die insert 23 is mounted for clamping the forged bar. This clamping die insert is a counter-tool in relation to the top working surface 22*b* of the bottom part 22 of split die insert for shaping the crank webs.

Taking into consideration that the said device is designed for forging first of all the long stroke crankshafts and the working space of a forging press is limited, so the device base is constructed as follows: two base beams 4 are linked by a base cross member 25 and by the bottom die holder 12. Both, base cross member 25 and bottom die holder 12 have lateral protrusions, which are marked in FIG. 6 by number 25*a* and in FIG. 1 by number 12*a*. These protrusions enter in corresponding recesses in the base beams 4. The whole base is tied crosswise by means of coupling bolts 26.

Each of base beams 4 has the shape similar to the letter "U". The top parts of each base beams 4 are tied by double T-shaped steady braces 27. The longitudinal (central) part of the steady brace 27*a* is situated in parallel to the base beam 4 and enters into longitudinal recesses which are made in top parts of base beam 4. The steady brace heads 27*b* rest on face surfaces 4*b* and 4*c* of the base beams 4.

Figure 6:
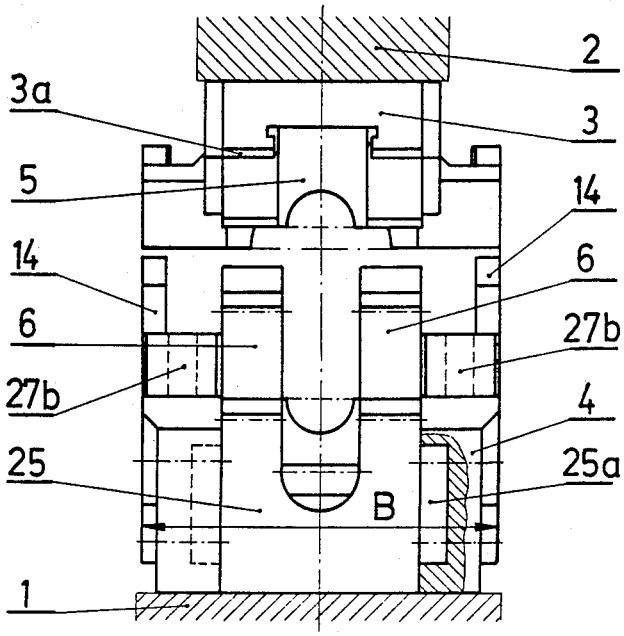
FIG. 6—shows front view of the device acc. to FIG. 1.

Application of the base beams 4 reinforced by steady braces 27 and provided with impressions 4*d* for fastening the die inserts and also placing the bottom die holder 12 in the space between the base beams 4 and mounting of arrester hooks 14 on pins 14*a*, which are positioned vertically to the base beams 4, allow to design the device with the width "B" smaller than usual—see FIG. 6. It is very advantagous because of limited distance between the press columns.

The device operates as follows:

The press-crosshead 2 is lifted to its top position. The top die holder 13 is engaged by means of catches 3*c* and 13*b* and additionally underslung by means of coupling bar 16 to the device head. The bottom and top die holder 8 and 5 are shifted to the extreme left by means of hydraulic cylinders not shown in the drawing. In this position of die holders 8 and 5 the pivoted connectors are inclined to the right—it means in the direction of the second die holders 12, 4*d* and 13. Arrester hooks 14 are inclined to the right-hand side.

Most of forging presses are equiped with a shifting table. Such a solution allows to shift the press table with the bottom part of the device out of the press and facilitate placing of a bar stock on the bottom dies and removing of the just forged crankshaft.

When forging a first crank web of the first crank throw of the crankshaft (FIGS. 20 and 22), the bottom part 20*c* of the rotary die insert is put on the bottom part 17 of the angle die insert. The top part 20*d* of the rotary die insert is placed into the top part 18 of angle die insert. The bar stock 24 heated up to forging temperature is placed on the bottom part 11 of the clamping die insert and on the bottom part 22 of shaping die and also on the bottom part 20*c* of the rotary die insert. Then, the press table is shifted toward the center line of the press and the press is set in motion. When the bar 24 touches the clamping die insert 23 and the top part 20*d* of rotary die insert the press drive is stopped and arrester hooks 14 are closed to engage the second top die holder 13 through the half round shafts 15 and protrusions 13*a*. So the top die holder 13 and the bottom die holder 12, 12*a* and 4*d* are rigidly coupled. After restarting the press cross-head 2 the forged bar 24 comes in contact with top die insert 21 and clamping die insert 10. So the left part of the bar 24 is also clamped and the device is closed. The movable bottom die holder 8 is coupled by the protrusion 8*a* with the movable top die holder 5. In that moment the second immovable top die holder 13 is independent of the device head 3 and the coupling bar 16 can be detached. During continuous downward movement of the press-crosshead the pivoted connectors 6 and 7 are inclined to the right and the movable bottom die holder 8 coupled with the movable top die holder 5, which is guided by horizontal guides 3*a*, are shifted to the right. At the first phase of the above said motion the upsetting with simultaneous bending of the bar portion which is between face surface of dies 11, 12 and 22 and 23 takes place. It is shown in FIG. 21. The letter "R" in this drawing means the length of the toggle connectors 6 and 7 measured between the axis of their articulated joints, the letter "r" means total bending and joggling way, S—means total upsetting way, $\alpha_1$—inclination angle of the articulated connectors 6 and 7 at the beginning of working stroke, $\Delta S_1$—initial upsetting velocity, $\Delta r_1$—initial bending and joggling velocity. As it is shown in FIG. 21 the initial upsetting horizontal velocity $\Delta S$ of the die holders 5 and 8 and die inserts is higher than the initial bending vertical velocity $\Delta r$. The vertical movement component causes bending or joggling of just forged bar.

During next phases of the press working stroke the upsetting velocity diminishes while the joggling velocity increases. It is shown in FIG. 23. The letters B, r and S have the same meaning as above, $\alpha_2$—means the inclination angle of the articulated connectors 6 and 7 at the end of working stroke. $\Delta S_2$—terminal upsetting velocity, $\Delta r_2$—terminal bending and joggling velocity.

In this phase of working stroke the face surfaces 21*a* and 22*a* of the top and bottom die inserts 21 and 22 move toward each other. At the end of the working stroke between these surfaces 21*a* and 22*a* the crank web is formed. The vertical guides 3*b* of the head 3 slide on vertical guides 4*a* of the base and take over the friction forces which appear when shifting the top die holder 5 on horizontal guides 3*a*. After finishing the working stroke the arrester hooks 14 are inclined to the right (opened) by means of hydraulic cylinders (not shown in the drawing) and the press cross-head 2 is being lifted till catch of the head 3*c* engages the catch 13*b* of the top die holder 13. In that moment the press drive is stopped and the second top die holder 13 is underslung to the device head by means of coupling bar 16. Then, the press is set in motion and the press cross-head 2 is lifted to its top position. When the work-piece is removed from the dies the top and bottom die holder 5 and 8 is shifted to the left by means of hydraulic cylinders not shown in the drawing.

To forge the second crank web of the same crank throw the hot forging is placed in the device in the way like the one described above when forging the first crank web, the difference being that the bearing journal which is on the end of the forged first crank web has to be inserted in the bottom recess 19*a* of the impression 19. Then, rotary angle die insert 20 is mounted in the impression 19 in such a way that the recess 20*a* encloses that bearing journal. The next phases of crank web forming are similar to those of forming the first crank web of the first crank throw. Thus, the first crank throw of the crankshaft is forged.

After opening the device and removing the forging from dies, the dies are set in their initial position and the device is ready to forge the first crank web of the second crank throw. This forming process is similar to that of forming the second crank web of the first crank throw, but the forged crank pin of the just forged crank throw has to be placed in the adequate recess 19*b*, 19*c* . . . 19*i* for setting the crank throw at proper twist angle.

After forging the first crank web of the second crank throw the second crank web of the second crank throw is forged similarly as the second crank web of the first crank throw.

To avoid the curving of the forged workpiece it is advisable to support the just formed part of the crankshaft by supporting plates 28, 29 and 30. The method and the apparatus according to the invention are especially suitable for manufacture crankshaft forgings which have all crank pins and bearing journals of the same dimensions, because they are forged one after another in the same tools. However. it is also possible to forge crankshafts with different crank pins and bearing journals but it needs of course a greater amount of tools. A very important advantage of the apparatus according to the invention is that it comprises two sub-assemblies of different hight, but only the smaller one of these assemblies is limited by the hight of the press working space.

Figure 7:
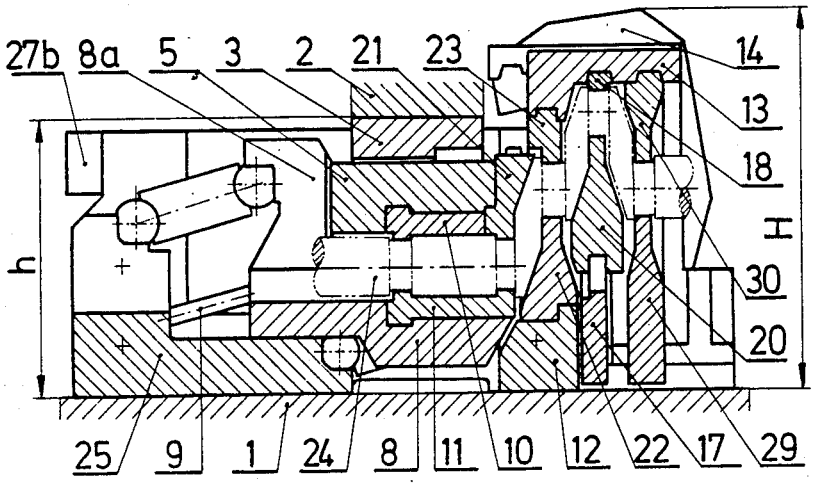
FIG. 7—shows lengthwise section of the device at the end of forming the first crank web of the next crank throw.
Figure 8:
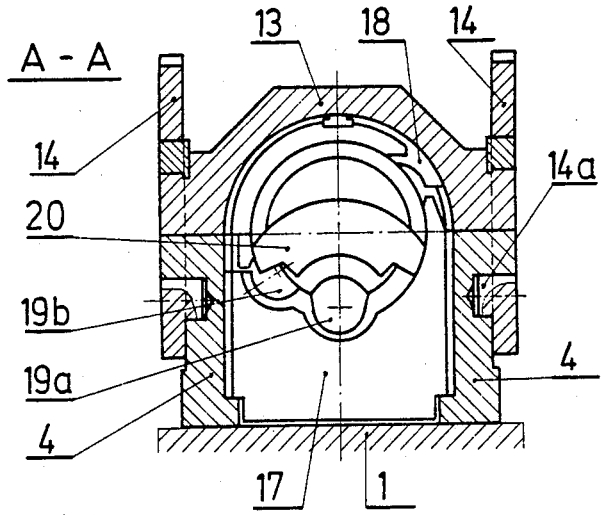
FIG. 8—shows the device in a section along line A—A in FIG. 3.
Figure 9:
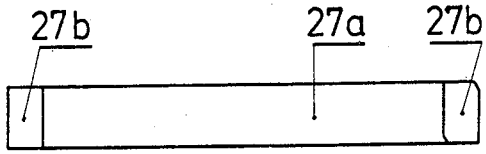
FIG. 9—shows side view of the double T-shaped steady brace.
Figure 10:
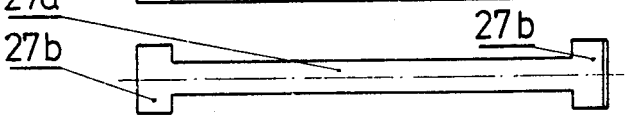
FIG. 10—shows the same steady brace in top view.
Figure 11:
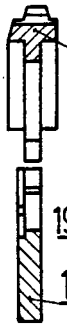
FIG. 11—shows lengthwise section of the angle die insert without supporting plate.

The first sub-assembly which is shown on the left-hand side of the drawing is located between the press cross-head 2 and the base elements 4 and 25. This sub-assembly is smaller (the height h in FIG. 7) and consists of parts which move during the working stroke, such as the head 3 and only one pair of coupled movable die holders 5 and 8. The top die holder 5 is guided by guides 3*a* of the head 3 and the bottom die holder 8 is pivotably connected with the base by means of toggle connectors 6 and 7. The left part of the forged bar 24 is clamped between dies 10 and 11 which are mounted in the top and bottom movable die holders 5 and 8. The second sub-assembly of the device is higher (height H in FIG. 7) and is located beyond the press cross-head. It consists of elements which are stationary during forging process such as the second pair of die holders 12, 12*a*, 4*d* and 13 and die inserts 22, 23, 17, 18 and 20 for shaping the crank webs and setting them at proper twist angles. The just forged ready crankshaft parts which have a voluminous configuration are also placed in this sub-assembly. The second sub-assembly is located beyond the press working space and its height H is not limited by the height of this space. Therefore the forming of the crank throw can be performed beyond the space between the head 3 and the base. This permits to forge long stroke crankshafts in presses having relatively small working spaces.

Another advantage of the apparatus according to the invention is that—differently from the previous solutions—all crank throws can be forged with the application of the same angle die inserts 17, 18, 20. The rotary angle die insert 20 can be applied for forging crankshafts of the same type independently of the crank throw number. The apparatus according to the invention alows to diminish the number of tools and thus to decrease the production costs.

I claim:

1. In an apparatus for forging a crankshaft from a bar, the combination comprising:

a base;

a head mounted for reciprocal movement toward the base in a working stroke;

one movable upper die holder mounted on said head for sliding in a direction transverse to the head movement;

one movable lower die holder;

connectors articulately linking the lower die holder to the base, each connector having an upper end pivotally linked to the lower die holder and a lower end pivotally linked to the base;

drive means for coupling the upper and lower die holder so as to provide their simultaneous, synchronous movement;

an immovable lower die holder rigidly connected to the base;

an upper die holder which is immovable during the working stroke;

clamping means for connecting said upper immovable die holder to the immovable lower die holder;

two sets of die inserts each set having portions carried by respective upper and lower movable and immovable die holders, said die inserts being adapted to grip the bar on both sides of the site of a crank web to be forged; and additional die inserts mounted between and to the immovable lower and upper die holders, said additional die inserts being fixedly spaced from said die inserts of said immovable lower and upper die holders so as to set the adjacent crankwebs at preselected twist angles upon clamping of said immovable lower and upper die holders.

2. An apparatus according to claim 1, wherein the immovable upper and lower die holders are mounted on the outside of the space between the head and the base.

3. An apparatus according to claim 1, wherein said base consists of two U-shaped beams, the top parts of each beam are mutually connected by means of a steady brace and both beams are interconnected by cross members, one of said cross members being articulately linked to said connectors and a second cross member constitutes the bottom part of said immovable lower die holder.

4. An apparatus according to claim 1, wherein said clamping means consists of at least one arrester hook articulately connected to the base, and which abuts on a half-round bearing shaft situated at the top part of the upper immovable die holder.

5. An apparatus according to claim 1, wherein said additional die inserts consist of a top part and a bottom part, and said parts together are provided with an impression, at the edge of which recesses are situated to determine twist angles of the crank webs to be forged, and in said impression a rotary die insert is mounted which is provided with a recess situated on its edge.

6. An apparatus according to claim 1, wherein said head is provided with vertical guides mounted for sliding on vertical guides situated on the base.

7. An apparatus according to claim 1, wherein said upper immovable die holder is provided with means for attaching said die holder to the head.

* * * * *